US007357066B2

(12) United States Patent
Kang

(10) Patent No.: US 7,357,066 B2
(45) Date of Patent: Apr. 15, 2008

(54) SEALING STRUCTURE OF AN UP-DOWN TYPE PISTON ASSEMBLY FOR EXHAUSTING A CONTENT

(76) Inventor: Sung Ill Kang, 201-1906, Shin Ahan Apt. 879-16, Bono-Dong, Sangrok-ku, Ahnsan-City, Gyeonggi-do 425-180 (KR)

( * ) Notice: Subject to any disclaimer, the term of this patent is extended or adjusted under 35 U.S.C. 154(b) by 197 days.

(21) Appl. No.: 10/533,298

(22) PCT Filed: Sep. 30, 2003

(86) PCT No.: PCT/KR03/01990

§ 371 (c)(1),
(2), (4) Date: Nov. 1, 2005

(87) PCT Pub. No.: WO2004/041022

PCT Pub. Date: May 21, 2004

(65) Prior Publication Data

US 2006/0127255 A1 Jun. 15, 2006

(30) Foreign Application Priority Data

Nov. 5, 2002 (KR) ..... 20-2002-0033087

(51) Int. Cl.
*F01B 3/00* (2006.01)
*F16J 1/00* (2006.01)

(52) U.S. Cl. ..... 92/33; 92/136; 92/255

(58) Field of Classification Search ..... 92/31, 92/33, 136, 2, 248, 255; 277/354, 430
See application file for complete search history.

(56) References Cited

U.S. PATENT DOCUMENTS

| | | | | |
|---|---|---|---|---|
| 4,175,475 | A * | 11/1979 | Eckhardt | 92/33 |
| 4,493,614 | A * | 1/1985 | Chu et al. | 92/33 |
| 5,636,931 | A | 6/1997 | Gueret | |
| 6,079,715 | A * | 6/2000 | Johnen et al. | 277/565 |
| 6,230,762 | B1 | 5/2001 | Baudin et al. | |

FOREIGN PATENT DOCUMENTS

| | | | |
|---|---|---|---|
| JP | 2000-0309387 | A | 11/2000 |
| KR | 1992-0019010 | U | 11/1992 |
| KR | 1993-0005398 | Y1 | 8/1993 |
| KR | 1998-0034351 | U | 9/1998 |
| WO | WO2002/067721 | A1 | 9/2002 |
| WO | WO2004/041022 | A1 | 5/2004 |

* cited by examiner

*Primary Examiner*—Michael Leslie
(74) *Attorney, Agent, or Firm*—Foley & Lardner LLP

(57) ABSTRACT

The disclosed sealing structure is used with a piston assembly which exhausts a content. A sealing washer has a sealing hole through which a screw pillar is inserted and is configured to be formed between a piston and a screw cap of the piston assembly. The sealing washer is configured to seal a chink that is generated between threads of the screw pillar at an exhausting of the content when the piston assembly is removed by the screw pillar. The sealing washer has an elasticity such that any space between the sealing hole and the threads of the screw pillar is closed at the exhausting of the content.

13 Claims, 6 Drawing Sheets

SEALING STRUCTURE OF AN UP-DOWN TYPE PISTON ASSEMBLY FOR EXHAUSTING A CONTENT

This application is a National Stage application of PCT/KR 03/00 1990, filed Sep. 30, 2003, which claims priority from Korean patent application 20-2002-0033087, filed Nov. 5, 2002. The entire contents of each of the aforementioned applications are incorporated herein by reference.

BACKGROUND OF THE INVENTION

1. Field of the Invention

The present invention relates to the structure of the piston that is operated upward and downward by the revolving operation of the screw pillar for exhausting the liquid content that is contained to the inner portion of case. More particularly, it relates to a sealing structure of an up-down piston assembly for exhausting the content, which can prevent that the content is in-flown and spilled into the inner portion of the piston by way of the screw of the screw pillar at removing and operating of the piston.

2. Description of the Prior Art

Generally, the present invention relates to the structure for exhausting the content as same as cosmetics, hairdye, etc. to the outside of case, and also the structure that is possible to exhaust the content to the outside of case is recently used because the piston is operated upward and downward to the inner portion of case by the screw pillar that is revolved and manipulated into one direction by the push operation of the exhaust device.

But, as exemplarily shown in FIG. 1, in case of the prior art as such, it has such a structure that all of the piston (21) of the piston assembly (2) that is assembled to be possible to move mutually to the screw pillar (1) and the piston sealing assistant ring (22) are mutually assembled to the inside face with the screws (21*a*, 22*a*) that are corresponded to the screw (11) of the screw pillar (1), and also it has such a structure that it is possible to generate the imperceptible chink between the screw (11) of the screw pillar (1), the piston (21) and the screws (21*a*, 22*a*) the piston sealing assistant ring (22) because the screw pillar (1), the piston (21) and the piston sealing assistant ring (22) must be light in view of the function.

Accordingly, it has such the problems that if the exhausting device (5) that is placed to the upside of case, so that the content (4) that is contained to the inner portion of case (3) is exhausted to the outside of case by using the structure as stated above, is operated, in the chink that is generated between the screws (21*a*, 22*a*) that are formed to the piston (21) that is removed by way of the screw (1) of the screw pillar (11) and the inside face of the piston sealing assistant ring (22), it brings the dissipation of the content (4), and also it is very difficult to operate for certainly exhausting the content because the content is spilled through the rear part of the piston (21) or the assembled chink of each of components as well as the arrow direction by the dwindling of the sealing ability, and also especially if the liquid content is more thin, these problems deepened.

SUMMARY OF THE INVENTION

It is an object for the present invention to provide the sealing structure of the piston assembly for exhausting the content, which can prevent that the content is spilled, or which can exhaust the total amount of contents by improving the sealing ability of the piston assembly that is removed by way of the screw pillar.

BRIEF DESCRIPTION OF THE DRAWINGS

The above object and advantages of the present invention will become more apparent by describing in detail preferred embodiments thereof with reference to the attached drawings in which.

DESCRIPTION OF THE PREFERRED EMBODIMENT

Figure 1:
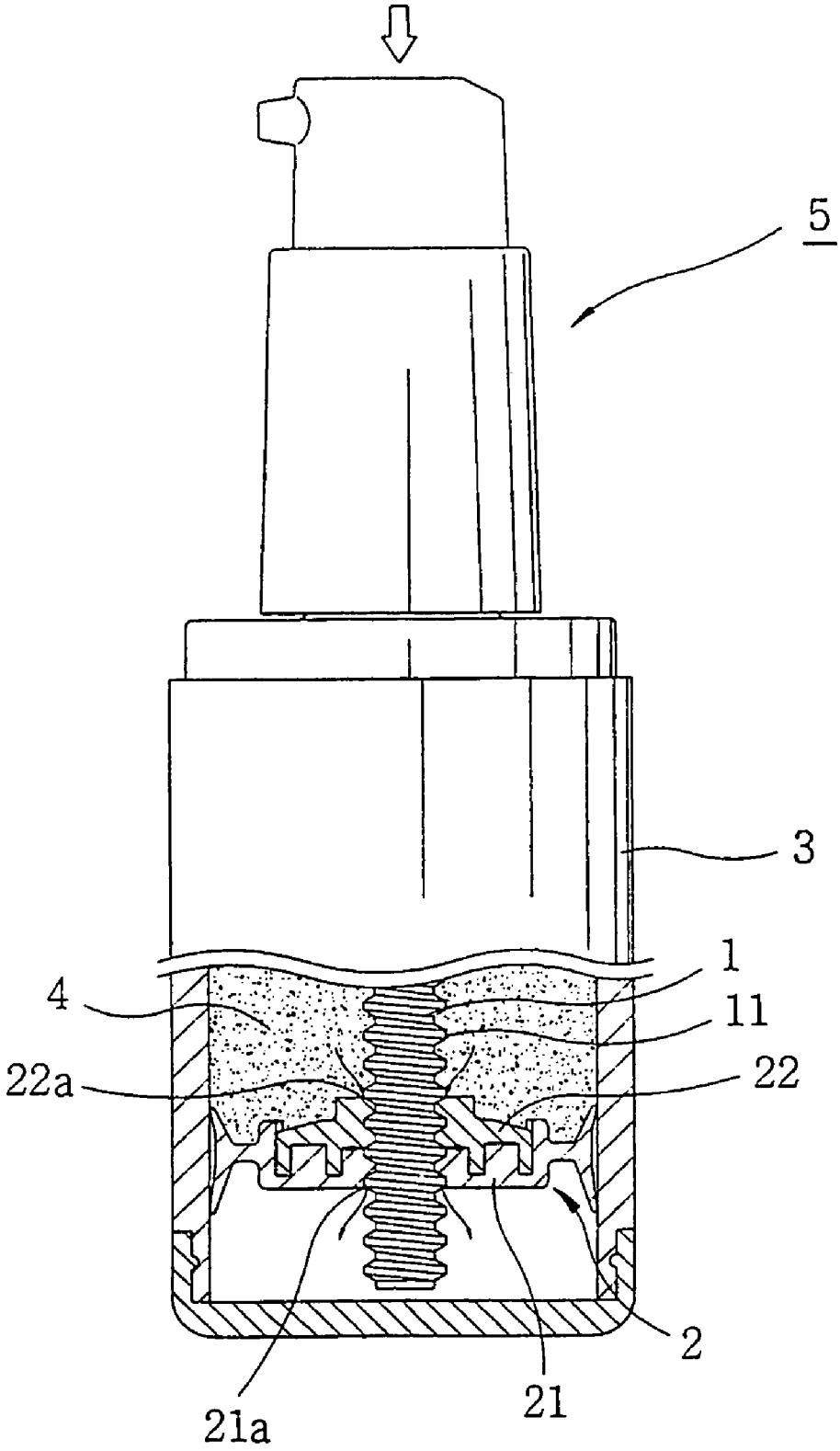
FIG. 1 shows a portion cut side view of the cosmetic case showing an embodiment of the piston structure according to the present invention.

The present invention is established to solve the problem stated above. Also, it has such characteristics that even though the screw pillar at the exhausting of the content removes the piston assembly, the chink is not generated between the threads of the screw pillar by the sealing washer because the sealing washer placed between the piston and the screw cap has an elasticity that has been entirely satisfactory, and the spill of the content can be prevented.

According to the present invention, it is desirable that the material of the sealing washer is NBR, and also it is desirable that the hardness of NBR is within the limits of 20~50 degrees.

Also, it is desirable to equip the assembly with the sealing projection frame to the sealing washer.

Hereinafter, referring now to the drawings the embodiments according to this invention are described in detail.

Figure 2:
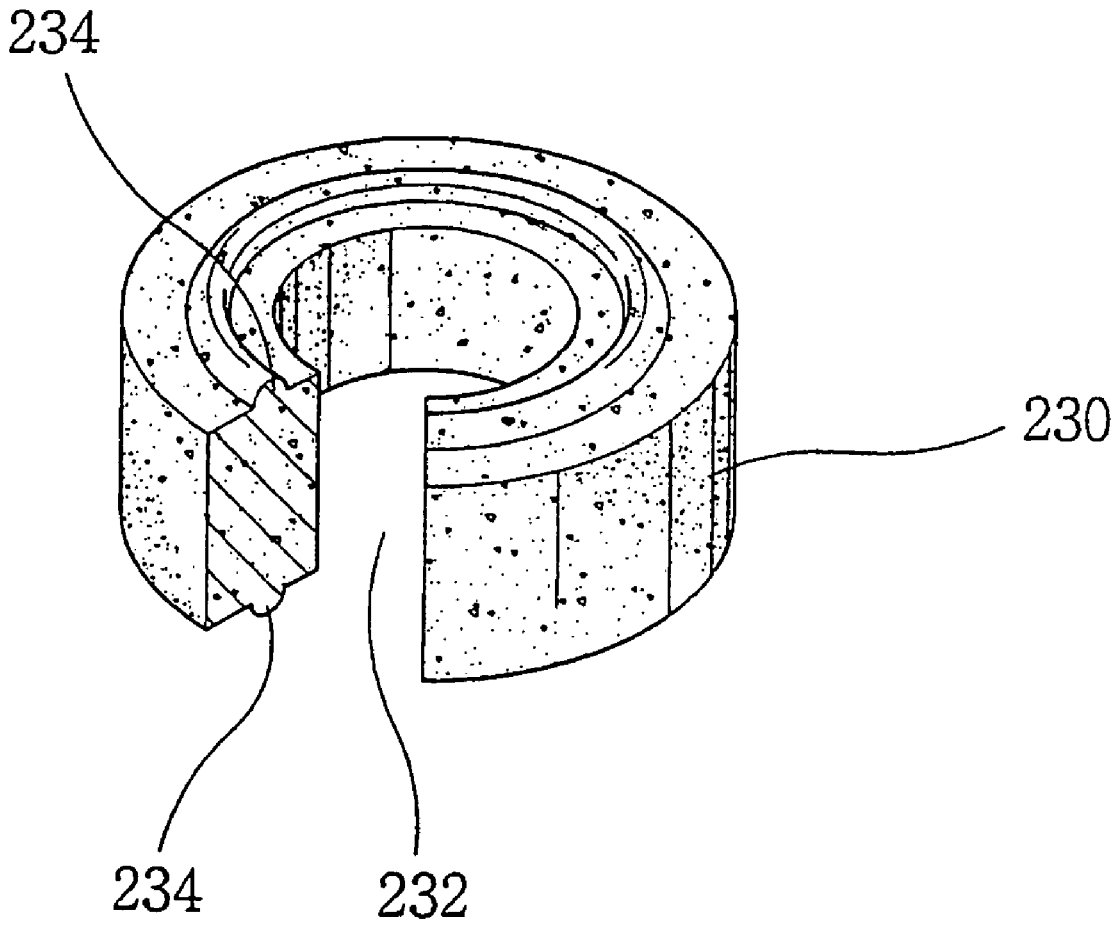
FIG. 2 shows an extracted perspective view of the sealing washer according to the present invention.

FIG. 2 is a portion cutting perspective view showing the structure of the sealing washer comprising: the piston assembly (200) according to the present invention, the rubber washer (230) which is a cylinder type rubber, the sealing hole (232) that is formed to the screw pillar (100) (which will be described later) in its center, and the sealing projection frame formed on the upward and downward portions of the outside face of the sealing hole (232) as one body.

If the sealing washer (230) is comprised of the material having a certain elasticity as the rubber, it is desirable that its material is NBR (Nitrile Butadiene Rubber) having a certain hardness, and in this case it is desirable that the hardness is 20~50 degrees but it can be made without such a limitation. The reason why it has such a limitation of the hardness of NBR being 20~50 degrees is because for example, if the hardness is below 20 degrees, it is very thin and if the sealing washer (230) is removed by way of the screw pillar (100), it has the possibility that it is taken or protrudes, and also if the hardness is over 50 degrees, it is very hard and the sealing ability can be lowered.

Figure 3:
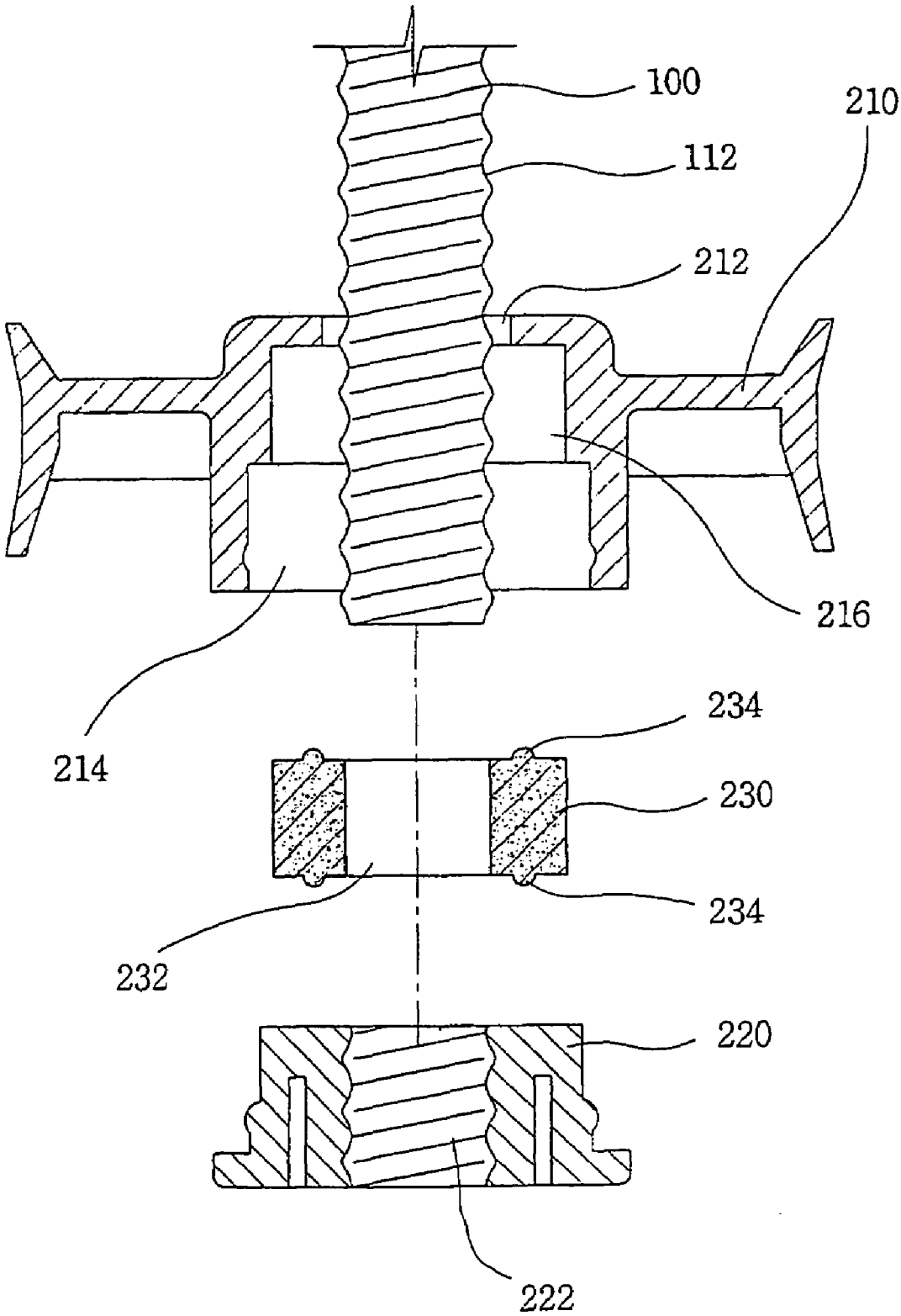
FIG. 3 shows a sectional view showing the state before the piston is assembled to the screw pillar according to the present invention.

FIG. 3 is a sectional view showing each of the components before the assembly of the piston assembly (200) at the screw pillar (100). The penetrating hole (212) has a diameter that is bigger than the screw pillar (100), which is formed to the piston (210) which, in turn, is formed to the piston assembly (200). The first accommodating area (214) that the hard (such as plastic) screw cap (220) is connected to and the second accommodating area (216) into which the sealing washer (230) is placed are formed in the inside space of the portion that is not equipped with any components around the piston.

The screw hole (222) connecting with the screw (112) that is formed to the outside face of the screw pillar (100) is formed to the screw cap (220) that is connected to the first accommodating area (214).

And the sealing hole (232) of the sealing washer (230) can elastically be put to the screw pillar (100) at mutually assembling of them after it is formed as more small size than the diameter of the screw pillar (100).

Figure 4:
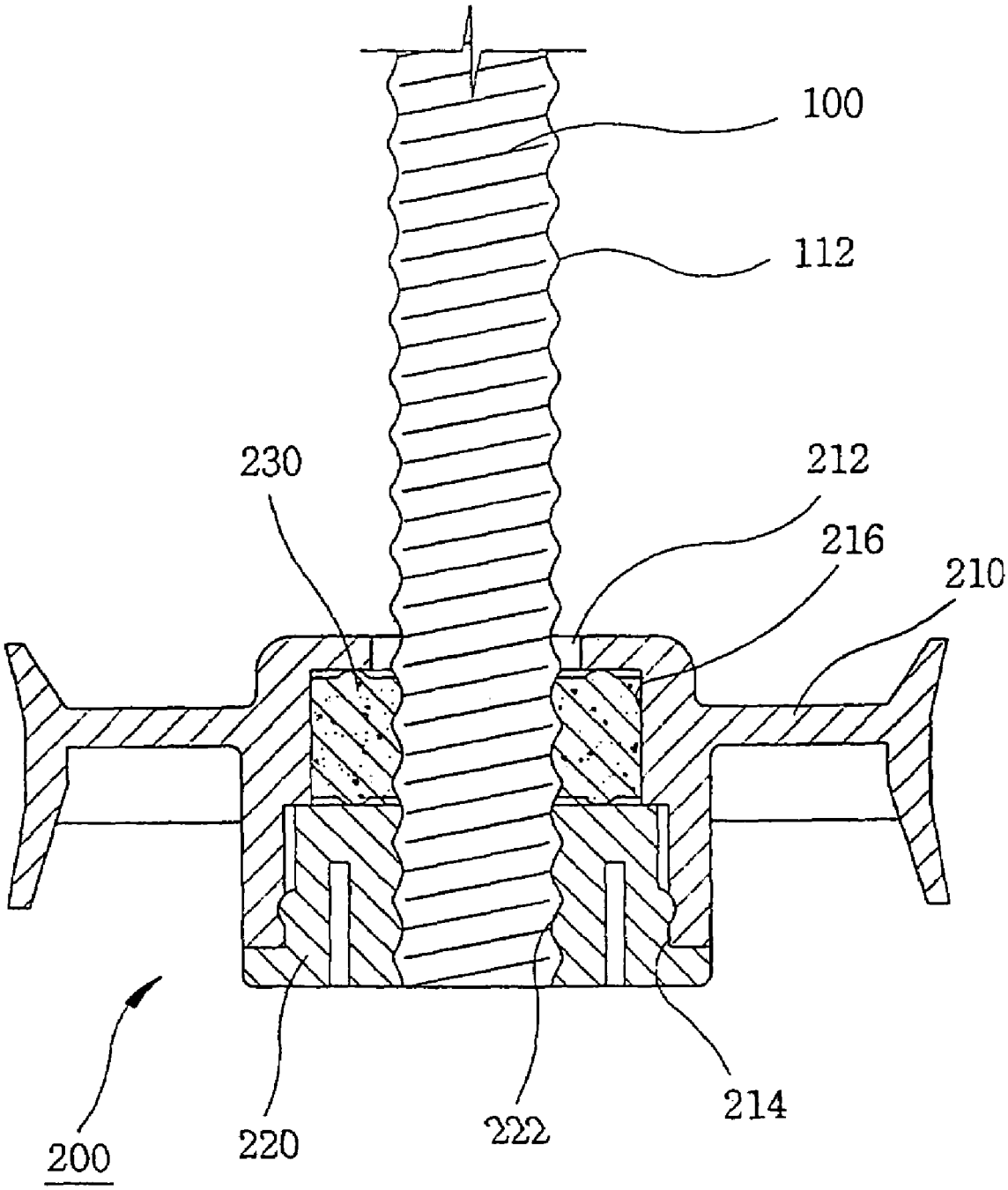
FIG. 4 shows a sectional view showing the state after the piston is assembled to the screw pillar according to the present invention.

FIG. 4 is a sectional view showing the state that the piston assembly is connected to the screw pillar (100), the sealing washer (230) is pushed and put to the inner of the second accommodating area (216) after the screw pillar (100) is penetrated to the penetrating hole (212) of the piston and then the screw cap (220) that the screw hole (222) is connected to the screw of the screw pillar (100) is connected to the first accommodating area (214).

At this time, the sealing washer (230) that is put and placed to the second accommodating area (216) is closely clung to the inner portion of the second accommodating area (216) by connecting of the screw cap (220), and also the chink is sealed because the projection (234) is very strongly impacted to the first accommodating area (214) and the contacted face corresponding to the screw cap (220), and the space between the sealing hole (232) is closed because the sealing hole (232) of the sealing washer (230) is elastically impacted to the screw (112) of the screw pillar (100).

Figure 5:
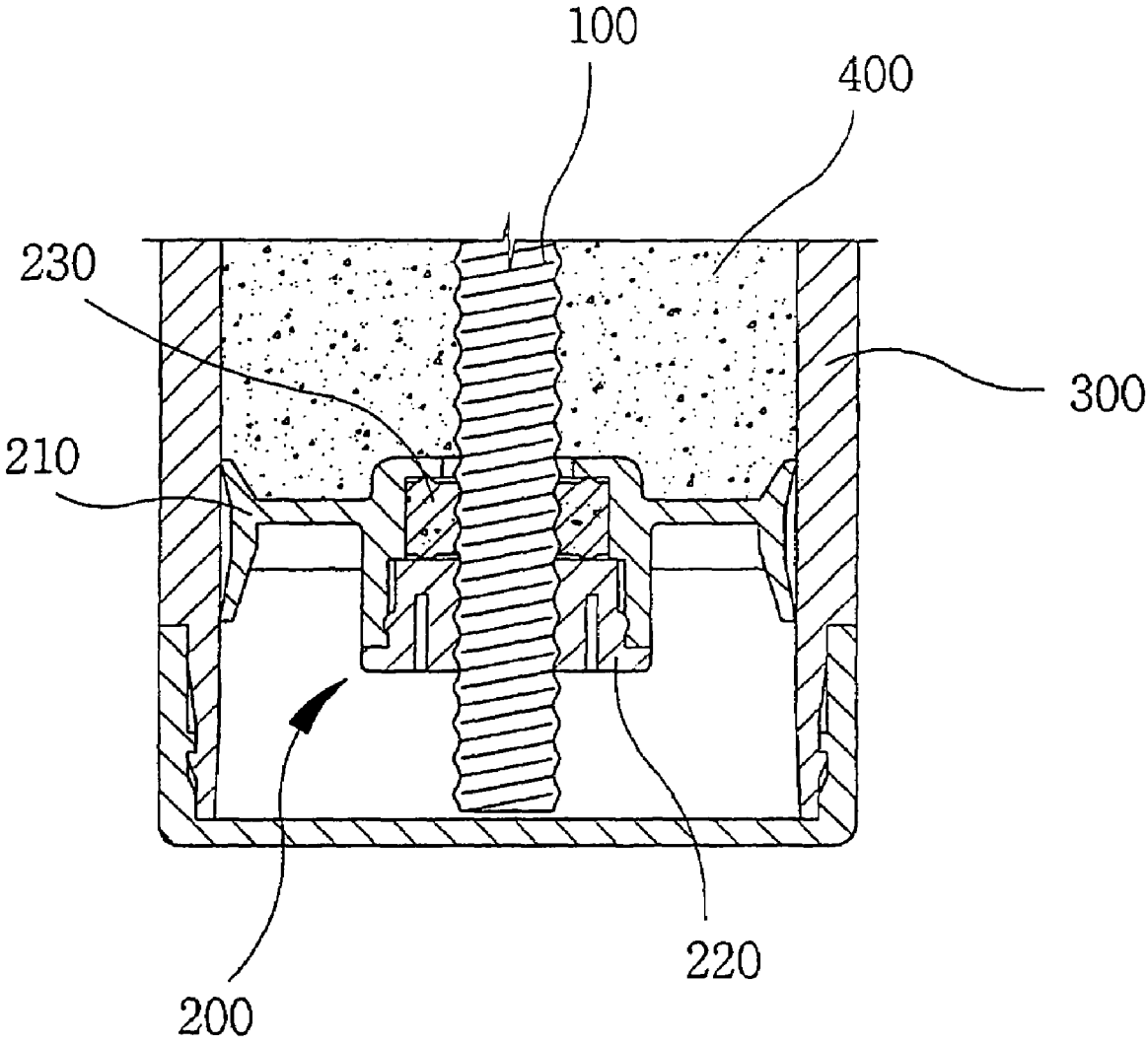
FIGS. 5 and 6 show side-sectional views of portions of the case showing an embodiment of the use of the piston according to the present invention.
Figure 6:
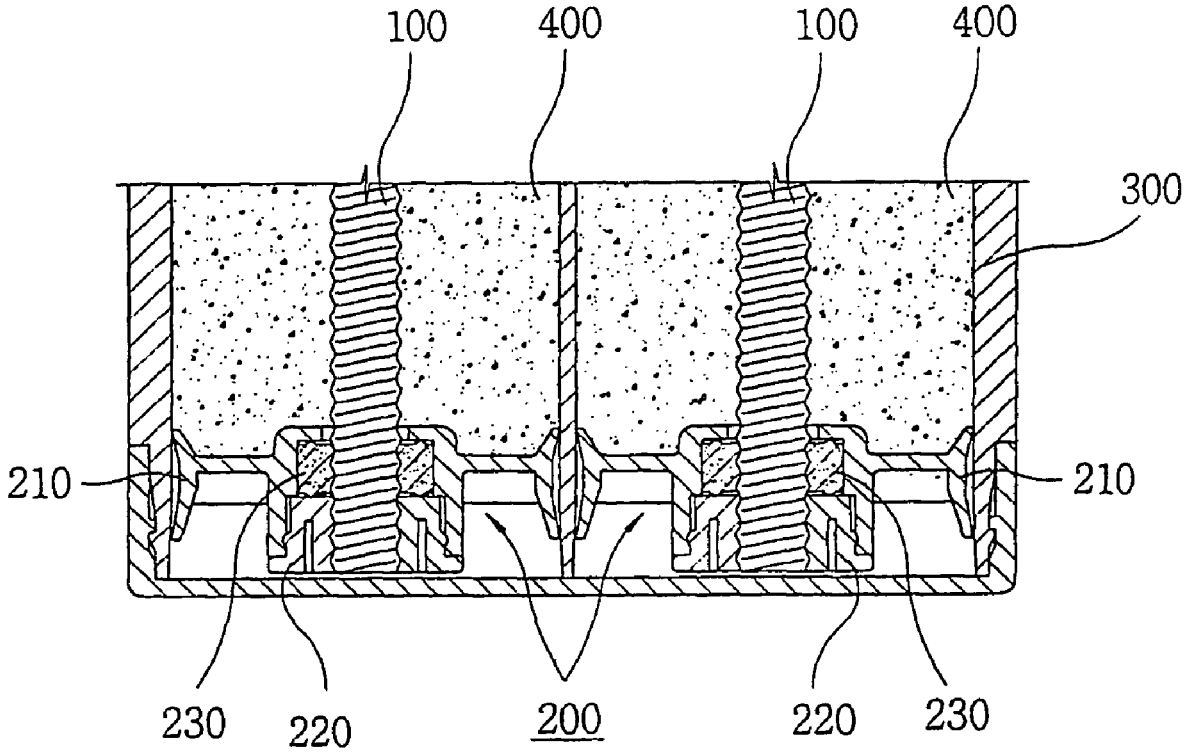

According to the present invention established as above, as shown in FIGS. 5 and 6, if the content is exhausted into the outside of the case (300) after the screw pillar (100) is removed to the center of case because if required, the piston assembly (200) is placed more than one or two to the inner portion of the case (300), the piston(210) is removed by the screw cap (220) that the screw hole (222) is connected with the screw (112) of the screw pillar (100) and also the sealing washer (230) that is elastically placed between the piston (210) and the screw cap (220) is removed as such the state that the chink that is generated between the screws (112) of the screw pillar (100) is certainly sealed and even if the content is poured through the penetrating hole (212) of the piston (210), it can certainly prevent that the content is spilled to the chink that is generated between the piston (210) and the screw cap (220) because the inner portion of the piston assembly (200) is entirely sealed by the sealing washer (230).

Accordingly, if someone uses the piston assembly (200) that is made by the present invention, it can certainly prevent that the content is spilled to the rear portion of the piston (210) by the sealing washer (230) at exhausting the content (400) that is contained to the case (300), and even if the content is very thin, the content is safely and certainly exhausted.

Lastly, in the present invention as stated above, it has such an advantage that the exhausting of the content can be completely operated because it is possible to remove the piston assembly that is removed by the screw pillar as such a state that the chink that is generated between each of the components and between the screw of the screw pillar is certainly sealed, and also it is possible to completely exhaust the content by enhancing of the sealing ability thereby.

While the invention has been shown and described with reference to certain preferred embodiments thereof, it will be understood by those skilled in the art that various changes in form and details may be made therein without departing from the spirit and scope of the invention as defined by the appended claims

What is claimed is:

1. A sealing structure for a piston assembly which exhausts a content comprising:

a sealing washer having a sealing hole through which a screw pillar is inserted and is configured to be formed between a piston and a screw cap of the piston assembly, wherein the sealing washer is configured to seal a chink that is generated between threads of the screw pillar at an exhausting of the content when the piston assembly is removed by the screw pillar, and wherein the sealing washer has an elasticity such that any space between the sealing hole and the threads of the screw pillar is closed at the exhausting of the content.

2. The sealing structure for a piston assembly according to claim 1, wherein material for the sealing washer is nitrile butadiene rubber (NBR).

3. The sealing structure for a piston assembly according to claim 2, wherein the hardness of the NBR of the sealing washer is 20~50.

4. The sealing structure for a piston assembly according to claim 1, wherein the sealing washer comprises a cylindrical rubber body with a top flat surface, a bottom flat surface, and a sealing hole running from the top flat surface to the bottom flat surface.

5. The sealing structure for a piston assembly according to claim 4, wherein the sealing washer further comprises a first sealing projection located around the sealing hole at the top flat surface and a second sealing projection located around the sealing hole at the bottom flat surface.

6. A piston assembly for exhausting a content comprising:

a piston;

a screw pillar with threads;

a screw cap with threads that mate with the threads of the screw pillar;

a sealing washer is located between the piston and the screw cap, wherein the sealing washer has a sealing hole through which the screw pillar is inserted;

wherein the sealing washer is configured to seal a chink that is generated between the threads of the screw pillar at an exhausting of the content when the piston is removed by the screw pillar, and wherein the sealing washer has an elasticity such that any space between the sealing hole and the threads of the screw pillar is closed at the exhausting of the content.

7. The piston assembly according to claim 6, wherein material for the sealing washer is nitrile butadiene rubber (NBR).

8. The piston assembly according to claim 7, wherein the hardness of the NBR of the sealing washer is 20~50.

9. The piston assembly according to claim 6, wherein the sealing washer comprises a cylindrical rubber body with a top flat surface and a bottom flat surface, wherein the sealing hole runs from the top flat surface to the bottom flat surface.

10. The piston assembly according to claim 9, wherein the sealing washer further comprises a first sealing projection located around the sealing hole at the top flat surface and a second sealing projection located around the sealing hole at the bottom flat surface.

11. The piston assembly according to claim 6, wherein the piston includes a first accommodating space in which the sealing washer is inserted.

12. The piston assembly according to claim 11, wherein the piston includes a second accommodating space in which the screw cap is inserted.

13. The piston assembly according to claim 12, wherein the second accommodating space has a larger diameter than the first accommodating space.

* * * * *